US005663746A

United States Patent [19]

Pellenberg et al.

[11] Patent Number: 5,663,746

[45] Date of Patent: Sep. 2, 1997

[54] INTERACTIVE INFORMATION KIOSK ASSEMBLY

[75] Inventors: Alan Pellenberg; Thomas A. Lamar, III, both of Atlanta; David L. Wikle, Smyrna; W. Glenn Nix, Duluth; Stephen Jaworski, Jr., Smyrna, all of Ga.

[73] Assignee: Miller/Zell, Inc., Atlanta, Ga.

[21] Appl. No.: 376,156

[22] Filed: Jan. 20, 1995

[51] Int. Cl.[6] ..... G09G 5/00

[52] U.S. Cl. ..... 345/113; 434/105; 361/682; 211/70

[58] Field of Search ..... 345/173, 113, 345/133, 150; 211/40, 70, 163, 165; 235/375, 304; 312/135; 348/825, 839, 840; 356/402, 42; 361/681, 682; 364/400, 401 R; 434/74, 98, 105

[56] References Cited

U.S. PATENT DOCUMENTS

| | | | |
|---|---|---|---|
| 1,837,743 | 12/1931 | Wilson et al. | 434/105 |
| 2,828,554 | 4/1958 | Harris | 434/105 |
| 3,693,807 | 9/1972 | Larson | 211/163 |
| 3,727,000 | 4/1973 | Lollos | 348/840 |
| 3,998,334 | 12/1976 | Smith | 211/70 |
| 4,084,194 | 4/1978 | Hector | 348/840 |
| 4,236,769 | 12/1980 | Mueller | 312/135 |
| 4,604,061 | 8/1986 | Willcocks et al. | 434/74 |
| 4,763,356 | 8/1988 | Day, Jr. et al. | 345/173 |
| 4,873,643 | 10/1989 | Powell et al. | 395/155 |
| 5,237,157 | 8/1993 | Kaplan | 364/401 R |
| 5,259,515 | 11/1993 | Koeppel | 211/40 |
| 5,317,503 | 5/1994 | Inoue | 364/401 R |

*Primary Examiner*—Steven Saras
*Attorney, Agent, or Firm*—Isaf, Vaughan & Kerr

[57] ABSTRACT

An interactive information kiosk assembly (10) for use by automotive dealerships, or the like, to inform potential customers about the exterior paint colors and the colors and materials for upholstery and trim available for selected model automobiles. The interactive information kiosk assembly (10) has a series of turntable assemblies (58, 59, 61) having a series of color and material swatches (67, 68, 69) that are indicative of the color and material choices available for the exterior paint, upholstery and trim of selected model automobiles. The turntable assemblies (58, 59, 61) are rotatable about a vertical axis extending through the kiosk assembly (10) to enable the customer to mix and match varying exterior paint colors with various upholstery and trim materials and colors. An interactive video display monitor (82) is provided for displaying a video image of a selected model automobile having a selected combination of exterior paint, upholstery and trim colors and materials.

7 Claims, 5 Drawing Sheets

INTERACTIVE INFORMATION KIOSK ASSEMBLY

FIELD OF THE INVENTION

The present invention relates to interactive information kiosk assemblies for use at automobile dealerships to present prospective customers with the various available colors and materials for the exterior paint, upholstery and trim for different model automobiles, and which enables customers to mix and match paint colors with varying upholstery and trim colors and materials to enable customers to visualize the appearance of a particular model automobile having a desired exterior paint, upholstery and trim color and material combination.

BACKGROUND OF THE INVENTION

The purchase of an automobile is a very expensive and personal decision generally made after careful consideration of a variety of factors. As part of the selection process, purchasers necessarily must decide between a myriad of colors and materials for the exterior paint, upholstery and trim of the automobile. The selection and matching of colors for an automobile, i.e. a particular shade of white for the exterior paint, matched with a tan leather interior and trim, is a matter of taste that is personal to a particular customer, and the styles and colors of paint, upholstery and trim available for a particular automobile can influence purchasing choices. In recent years, the choices of colors and types of materials available for exterior paint, upholstery and trim of automobiles has greatly increased, increasing the choices of style combinations of exterior paint, upholstery and trim available to customers.

A problem often encountered in the selection and matching of exterior paint colors and colors and materials for upholstery and trim for automobiles is that unless an automobile having a specific desired color and material combination is on the dealership lot, it is difficult for the customer to easily and properly visualize the appearance of an automobile with such a combination. As space on dealership lots is limited, it simply is not possible for dealers to maintain a large inventory of automobiles in all available exterior, upholstery and trim colors. Thus, purchasers who desire a particular color automobile with a particular upholstery and trim style and color often have to order the vehicle through the dealership instead of buying directly off the lot or have to search several dealerships. Before purchasers order an automobile, however, generally the purchasers want to see what the automobile would look like with the particular desired color combination, especially when choosing some of the newer, brighter colors such as yellow, plum or various shades of red.

The matching of body paint, upholstery and trim materials and color heretofore has been done using books having pictures showing the different body, upholstery and trim colors and styles. Typically, the books have small pictures of the automobile having a particular color and, separated from the pictures, are swatches of upholstery and trim materials. The problem with using such picture books it is difficult for customers to properly visualize the appearance of the automobile having their particular desired color combination from just a book without seeing the car itself. It is difficult to directly compare the exterior paint colors and upholstery and trim styles by flipping the pages of a book, and often a representation of a color in a book is different from the actual appearance of such a color on an automobile. Additionally, some customers want to find out the available colors and material styles for a particular model automobile, but do not want to deal with a salesman in the early stages of car shopping or a salesman may not be available to show a customer a particular automobile.

Accordingly, it can be seen that a need exist for a means for providing automobile customers with choices and availability of combination for exterior paint color, and upholstery and trim colors and materials for automobiles and which enables customers to directly match paint, upholstery and trim colors and materials, to enable customers to quickly and easily visualize the actual appearance of an automobile having such a color and material combination without requiring assistance.

SUMMARY OF THE INVENTION

The present invention generally comprises an interactive information kiosk assembly for use in the showrooms of automotive dealerships. The invention presents to prospective customers information with regard to the various choices for colors of exterior paint and colors and materials for upholstery and trim of automobiles. The invention informs customers about the various colors, styles and materials that are available for a particular model automobile, and enables customers to select and match exterior paint colors with materials and colors for the trim and upholstery of an automobile to provide the customer with a quick and accurate visual indication of the appearance of an automobile with such color and style choices.

The kiosk assembly generally is a substantially cylindrically shaped unit and includes a substantially cylindrically shaped base. The base includes a series of vertically extending support rods on which are mounted a series of shelves vertically spaced from one another. The shelves receive and support a computer processing unit and a video projection unit for the kiosk assembly. Removable cover panels are attachable to the base to conceal the computer processing unit and video projection unit within the base and provide the base with a substantially solid appearance.

A substantially cylindrically shaped internal core or support shaft is mounted upon an upper platform of the base approximately in the center thereof. The internal core is a section of tubing generally formed from cardboard, metal or a similar material, and includes a series of rollers or bearings mounted in vertically spaced sets and positioned about the circumference of the internal core. The rollers support a series of turntable assemblies vertically stacked about the internal core.

Each of the turntable assemblies is a substantially O-shaped ring having an inner diameter slightly greater than the diameter of the internal core. Each turntable assembly includes a substantially horizontal portion and an upstanding vertical portion or wall extending about the circumference of the horizontal portion. Swatches of colors and materials for the exterior paint, upholstery and trim of an automobile are mounted to the upstanding vertical portions of the turntable assemblies, spaced about the circumference of the turntable assemblies. For example, a first turntable assembly includes a series of swatches showing samples of paint colors for the exterior or body of an automobile, a second turntable assembly has a series of samples of upholstery of different materials, patterns and colors, i.e., tan or black leather or fabric, and a third turntable assembly includes samples of the colors and materials of the trim available for a particular color automobile. Each of the turntable assemblies rotates on the rollers about a vertical axis extending through the kiosk assembly and is rotatable independently of the other turntables. In use, a customer rotates the turntables to align swatches for a desired exterior paint color, upholstery color and material, and a trim color and material, and thus is able to directly compare materials and colors for a quick visual indication of how well these colors and materials match.

A video platform is mounted on top of the internal core, positioned immediately above the turntable assemblies. A video display monitor is received and seats upon the video platform. The video display monitor typically is a high resolution graphics monitor having touch screen interactive capabilities and is linked to the computer processing unit and video projection unit stored within the base of the kiosk assembly.

Customers input their desired color and material choices for the exterior paint, upholstery and trim of a specific model automobile and are appraised of the availability of such a color and material combination. If the combination is available, the customer is provided with a three-dimensional video image indicative of the appearance of the specific model automobile having the desired combination of exterior paint, trim and upholstery colors and materials. As a result, the customer is provided quickly and easily with a clear and accurate visual picture or indication of how certain matched colors and materials will appear when applied to an automobile.

Accordingly, it is an object to the present invention to provide an interactive information kiosk assembly for appraising customers of colors and material choices for the exterior paint, upholstery and trim of automobiles.

Another object of the present invention is to provide an informational kiosk assembly that enables customers for automobiles to mix and match exterior paint colors with colors and materials for the trim and upholstery of a particular model automobile in desired combinations.

Still another object of the present invention is to provide an interactive information kiosk assembly that enables customers to check the availability of desired combinations of exterior paint color, trim and upholstery colors and materials for specific model automobiles and to be provided with a visual representation of the actual appearance of an automobile having such a combination of exterior paint, upholstery and trim colors and materials.

A further object of this invention is to provide an interactive information kiosk assembly for appraising customers of the available choices for exterior paint colors and colors and materials for upholstery and trim for automobiles that is simple and easy for customers to use without assistance.

Other advantages, features and objects of the present invention will become apparent from the following specification when read in conjunction with the accompanying drawings.

DETAILED DESCRIPTION OF THE INVENTION

Figure 1A:
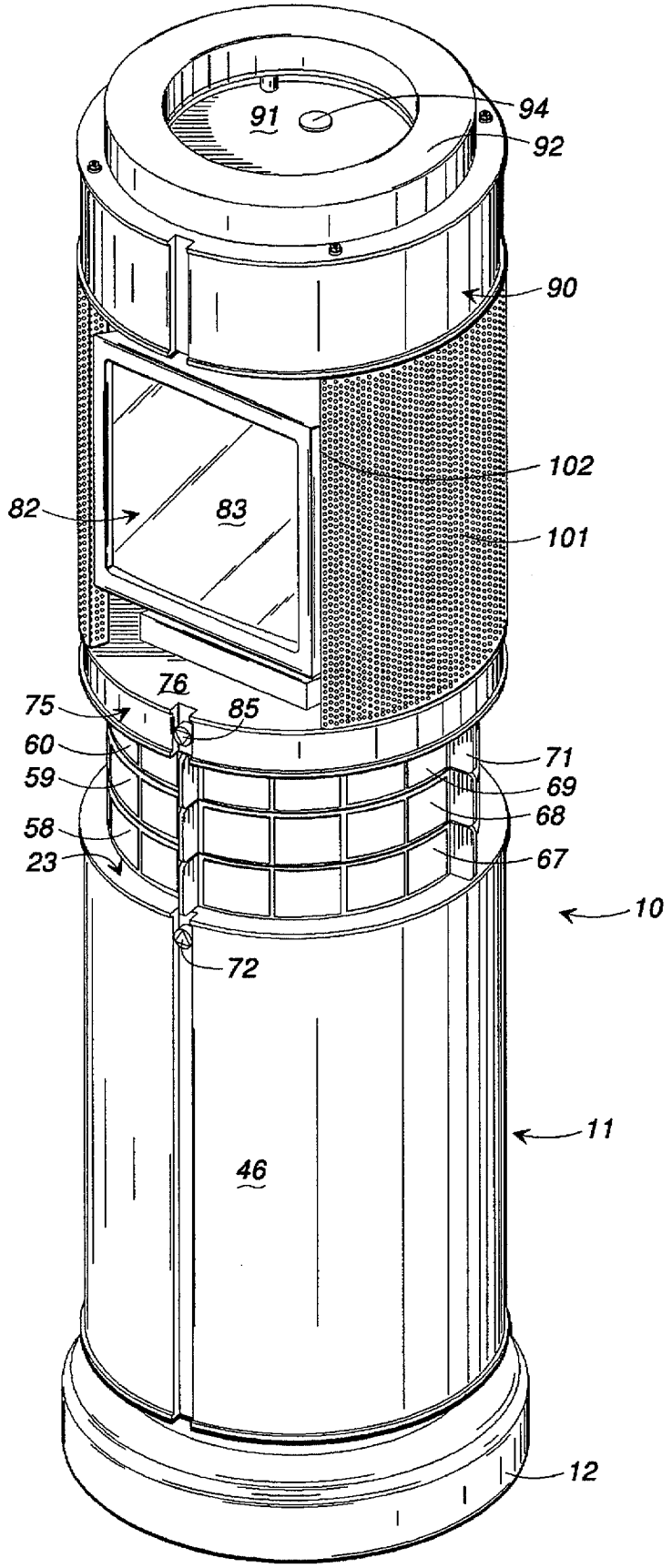
FIG. 1A is a perspective view of the interactive information kiosk assembly for displaying available color and material choices for the exterior paint, upholstery and trim for automobiles.

Referring now to the drawings in greater detail in which like numerals indicate like parts throughout the several views, the present invention comprises an interactive information kiosk assembly 10. The kiosk assembly generally is designed to be used in automobile dealerships for providing customers with information regarding the choices and availability of colors, materials and styles of exterior paint, upholstery and trim for specific model automobiles. The kiosk assembly generally is a substantially cylindrically shaped unit approximately 7–8 feet in height, and approximately 27–30 inches in diameter, although the kiosk assembly can be constructed in smaller or larger dimensions depending on the particular application.

Figure 1B:
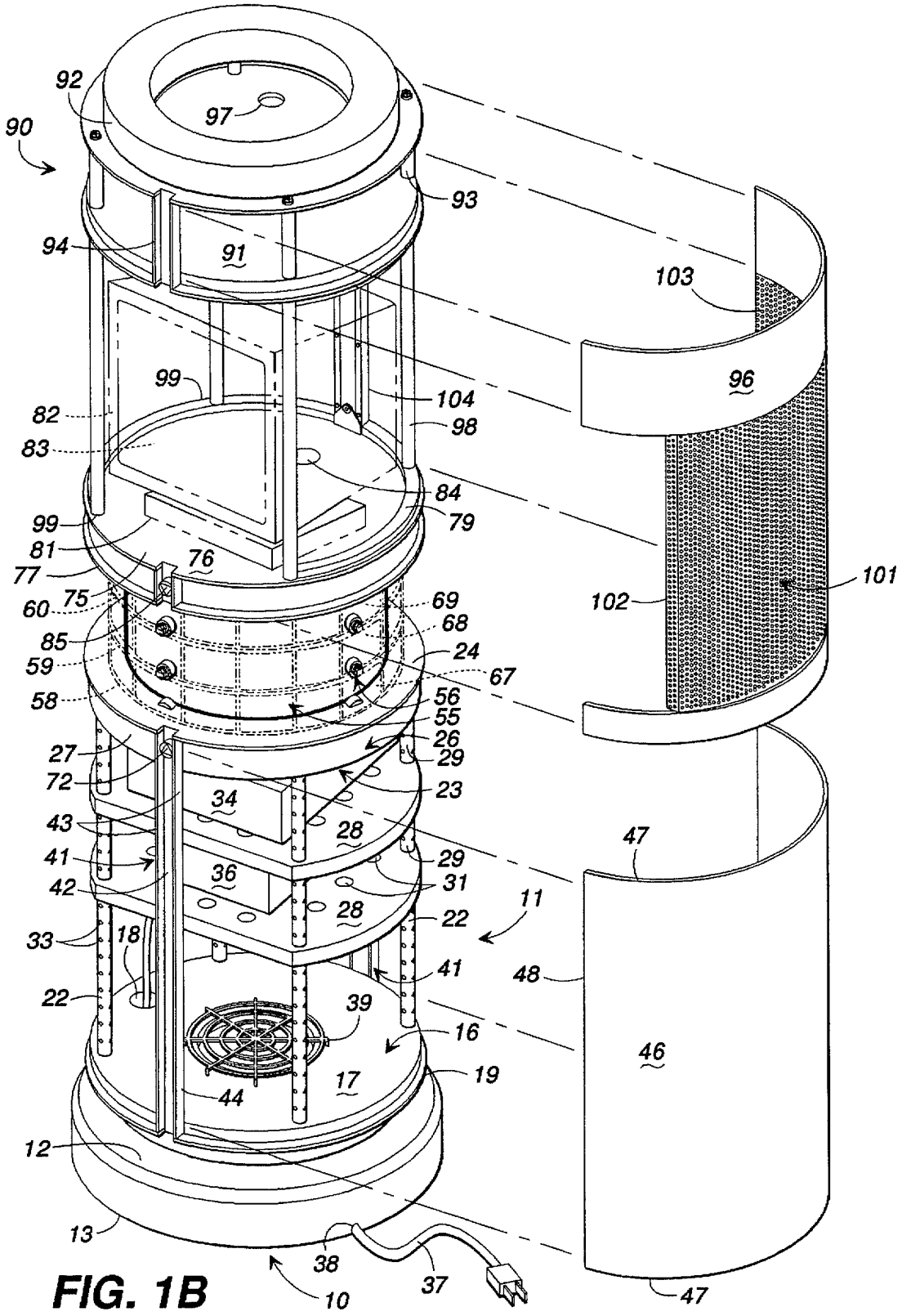
FIG. 1B is an exploded perspective view of the interactive information kiosk assembly for displaying available color and material choices for the exterior paint, upholstery and trim for automobiles.
Figure 2:
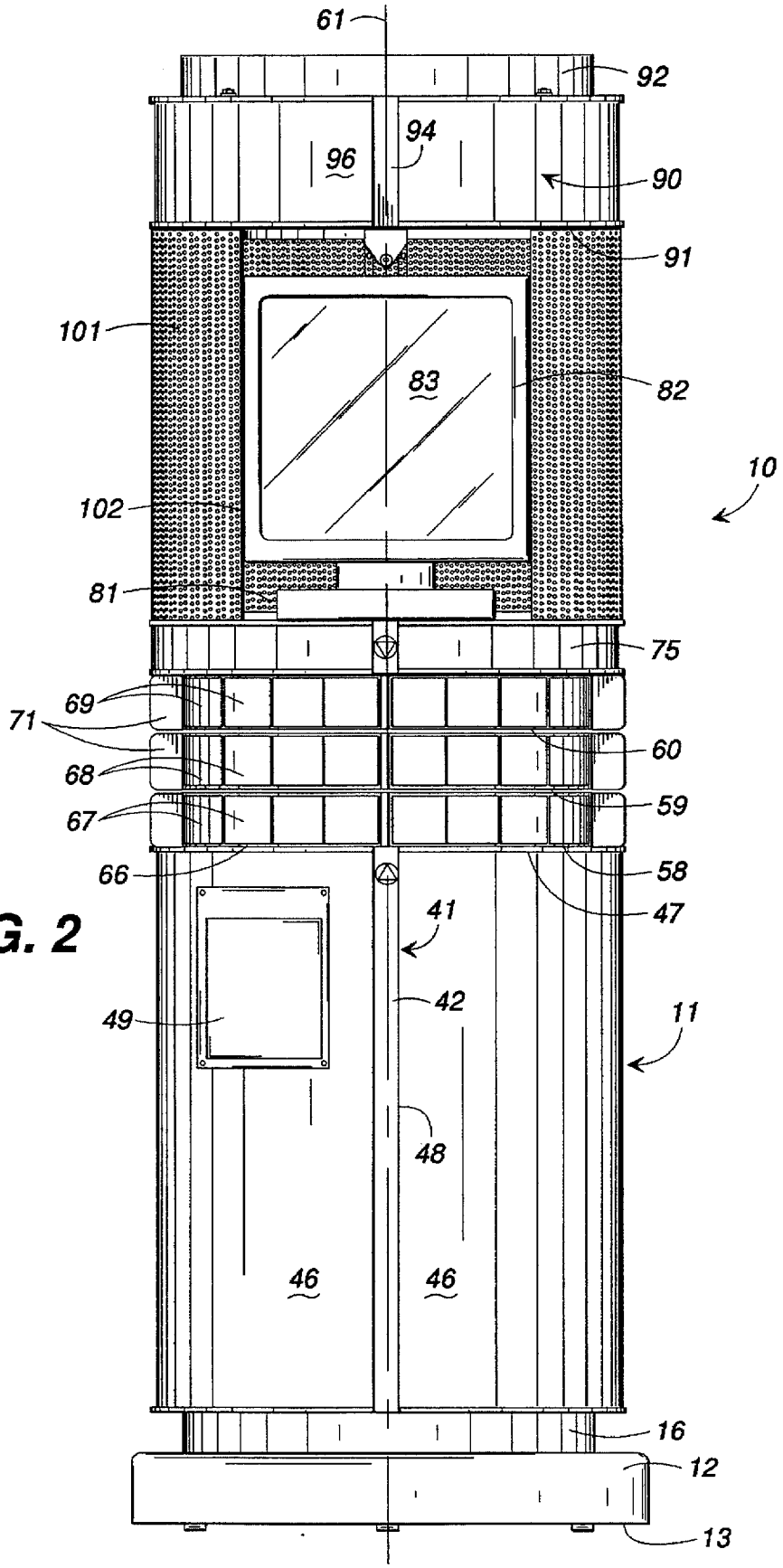
FIG. 2 is a front elevational view of the interactive information kiosk assembly.
Figure 3:
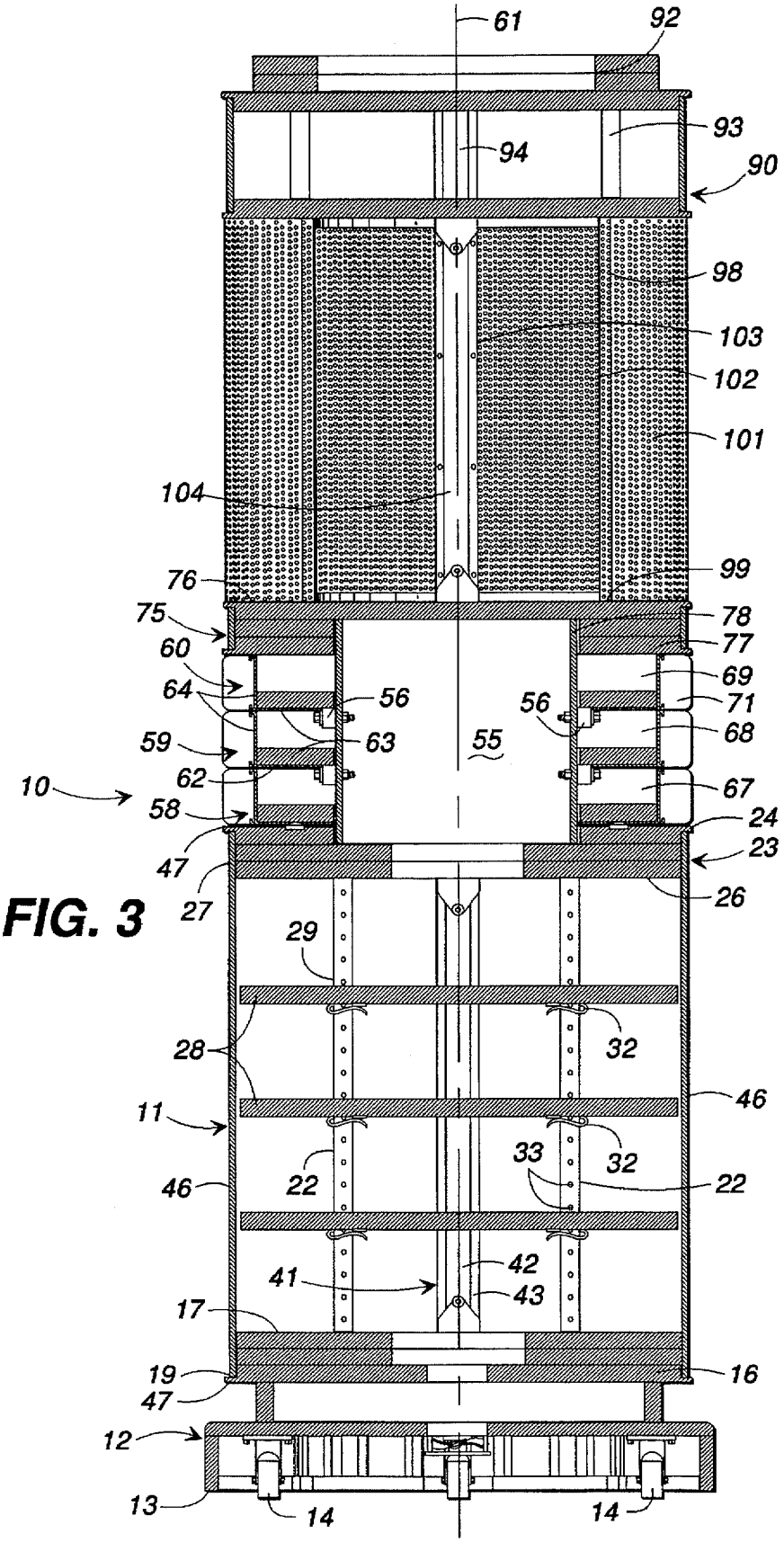
FIG. 3 is a front elevational view taken in partial cross-section illustrating the internal construction of the interactive information kiosk assembly.

As shown in FIGS. 1A–3, the kiosk assembly includes a base 11 that is approximately 3½–4 feet in height and approximately 27–30 inches in diameter. A skirt 12 is mounted at the bottom of the base 11 to add stability and further support to the kiosk assembly 10. The skirt generally is formed from molded medium density fiberboard (MDF) or a similar material, and has a diameter of approximately 30–36 inches and is 4–6 inches in height. A ground clearance of between ¼–½ inches is provided between the lower edge 13 of the skirt 12 and the surface upon which the kiosk assembly rests to enable free flow of air beneath the base 11. As FIG. 3 illustrates, rollers 14 are mounted to the underside surface of the skirt. Generally, four rollers are mounted to the skirt, spaced substantially equidistantly from one another. The rollers 14 generally are conventional swivel-type caster wheels or similar rolling means and support the kiosk assembly and enable the kiosk assembly to be rolled or moved easily to various locations.

As shown in FIGS. 1B and 3, the base 11 includes a lower platform 16 mounted on top of the skirt 12. The lower platform 16 is a substantially cylindrical platform generally formed from MDF, plastic or similar molded material. The lower platform includes an upper surface 17 with a cable or cord opening 18 formed therein, and a recess or step portion 19 formed in the outer peripheral edge 21 of the lower platform. A series of support rods 22 are mounted through the upper surface 17 of the lower platform 18 and extend vertically upwardly therefrom. The support rods generally are formed from aluminum or similar light-weight, strong metal material and are approximately 3–4 feet in length. An upper platform 23 (FIG. 3) is mounted to the upper ends of the support rods, positioned over and in alignment with the lower platform 18, supported by the support rods 22. The upper platform 23 has a substantially similar construction to that of the lower platform 18, and generally is formed from MDF or similar material. The upper platform includes an upper plate 24 and a lower portion 26 of a diameter slightly less than the diameter of the upper plate so that its outer peripheral edge 27 is overlapped by the upper plate.

As FIGS. 1B and 3 illustrate, a series of shelves 28 are mounted upon the support rods 22. Typically, 3–4 shelves are mounted on the support rods, although additional or fewer shelves can be used as desired. The shelves are substantially circularly shaped platforms or plates formed from MDF or similar laminate materials, and have a series of support rod openings 29 through which the support rods are received. The shelves further include a series of passages or bores 31 formed therethrough to enable the flow of air downwardly through the base 11. The position of the shelves is adjustable along the length of the support rods and the shelves are locked in place at a desired elevation by the insertion of pins or locking hasps 32 inserted through aligned openings 33 formed along the length of the support rods.

The shelves support a computer processing unit 34 and a video projection unit 36, such as a laser disc player or similar means for generating and projecting video images within the base. The computer processing unit is programmed with the availability of all possible combinations of colors and materials of exterior paint, trim and upholstery available for particular model automobiles, and controls the video projection unit for generating a three-dimensional video image of an automobile with the desired combination of exterior paint, upholstery and trim colors and materials. As shown in FIG. 1, the power cords for the computer processing unit and the video projection unit can be passed through the shelves and through the cable opening 19 formed in the upper surface 18 of the lower platform 17 of the base. The power cords for the computer processing unit and the video projection unit can be connected to a power strip (not shown), with the power cord 37 of the power strip passing through a mouse hole 38 formed in the lower edge 13 of the skirt 12 for connecting the kiosk assembly to the power supply.

Additionally, an exhaust fan 39 is mounted in the upper surface of the lower platform 16 of the base. The exhaust fan is a low noise fan and draws a flow of air through the air passages 31 formed in the shelves 28 in order to draw heat away from the computer processing unit and video projection unit to prevent these units from overheating. The air stream is exhausted from beneath the skirt, through the clearance between the lower edge 13 of the skirt and the ground surface.

The base 11 further includes a pair of support channels 41 which extend between the lower platform 17 in the upper platform 23 and are positioned on opposite sides of the base. The support channels generally are substantially U-shaped hat channels formed from extruded aluminum or a similar metal material. The support channels include a substantially U-shaped central web portion 42 and laterally extending flanges 43 that project outwardly from the central web. A fastening means 44, such as hook and loop fasteners such as velcro or hooks or snaps, is applied to the flanges 43 of the support channels 41.

Cover sheets 46 are applied about the base 11, as illustrated in FIG. 1B. The cover sheets are wrapped about the base in a substantially semi-cylindrical configuration with the horizontal side edges 47 of the cover sheets engaging the recessed peripheral edges 19 and 27 of the upper and lower platforms 16 and 23. The cover sheets 46 generally are flexible, substantially rectangular sheets of an aluco-bond material, which is a laminate material formed from a layer of styrene or similar plastic material sandwiched between layers of aluminum. The cover sheets generally are of a length substantially equal to the height of the base and are of a width approximately equal to ½ the circumference of the base. A mating fastening means (not shown), such as velcro strips, is applied along the vertical side edges 48 of the cover sheet and engages the fastening means 44 applied to the flanges 43 of the support channels 41 to attach the cover sheets to the support channel and about the base 11. As a result, as shown in FIGS. 1A and 2, the video projection unit and computer processing unit contained within the base 11 are concealed within the base and the base is given a solid outer appearance for aesthetic purposes, while still enabling quick and easy access to the computer processing unit and video projection unit contained within the base to the simple removal of the cover sheet.

Further, as shown in FIG. 2, a holding means 49 can be mounted to the cover sheets 46 for holding brochures, advertisement or other materials relating to automobiles and various colors, trim styles, etc., therefor. The holding means typically is a rectangularly-shaped pocket or box that can be fastened directly to the cover sheets, or can be applied to the cover sheets through means such as suction cups or adhesive to enable removal and repositioning of the brochure holding means.

As shown in FIGS. 1B and 3, a substantially cylindrical internal support shaft or core 55 is mounted to the upper plate 24 of the upper platform, extending vertically upwardly therefrom. The core is substantially cylindrically shaped and typically is formed from cardboard or similar light-weight, strong material such as plastic or even metal. The core is approximately 16 inches in diameter and approximately 10–12 inches in height. Rollers 56 are mounted to the internal core by pins or bolts 57 (FIG. 4), which secure the rollers to the internal core while still enabling the rollers to freely rotate. The rollers are arranged in sets of 4–6 rollers spaced about the circumference of the core, with each set of rollers arranged parallel to and vertically spaced from the other sets. Each of the rollers generally is from ½" to 1" diameter wheel or cylinder formed nylon, although it would be understood by those skilled in the art that other type of roller means can be used as well. Typically, there are three sets of rollers that support first, second and third turntable assemblies 58, 59 and 60 and enable the turntable assemblies to revolve about the internal core, so as to rotate about a substantially vertical axis 61 (FIG. 2) extending through the kiosk assembly.

Figure 4:
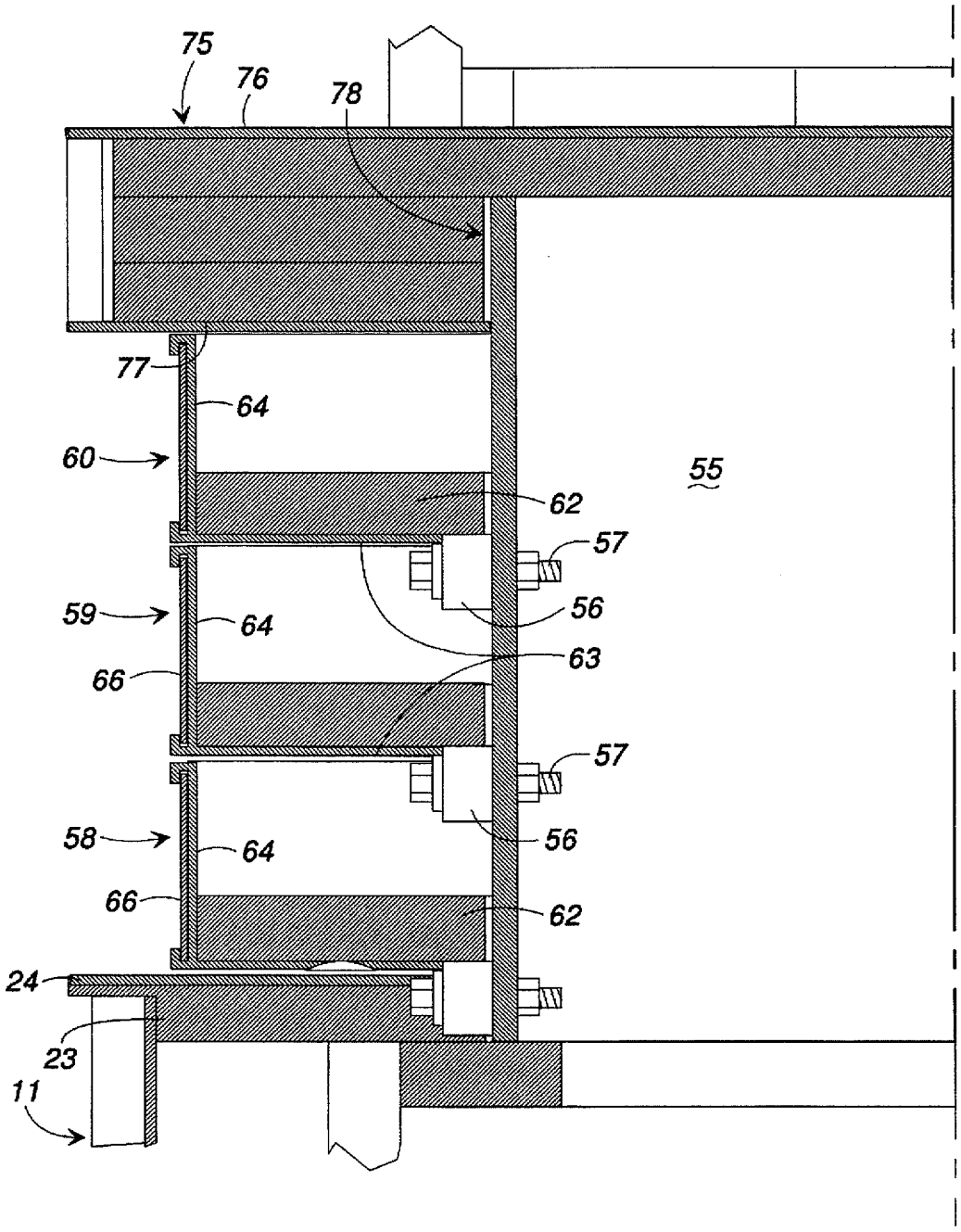
FIG. 4 is a cross-sectional view of a portion of the internal core and the turntable assemblies, illustrating the mounting of the turntable assemblies on rollers to enable the turntable assemblies to rotate about the internal core.

Each of the turntable assemblies 58, 59 and 60 generally comprises a substantially cylindrical ring having an inner diameter slightly greater than the diameter of the internal core. As shown in FIGS. 3 and 4, the turntable assemblies each include a substantially flat horizontal portion 62 formed from MDF and which extends outwardly from the internal core and includes a lower surface 63 that generally has a laminated surface and which engages and rests upon the roller 56. The engagement of the laminated lower surface 63 of the horizontal portion of each turntable assembly with the nylon rollers facilitates the smooth and quiet revolution of the turntable assemblies about the internal core. The turntable assemblies further include vertically extending portions 64 that project upwardly from the outer peripheral edges of the horizontal portions 63. As shown in FIG. 4, the vertical portion has a substantially C-shaped cross-section and receives a sample strip or sheet 66 formed from styrene or similar plastic material.

Swatches 67, 68 and 69 of exterior paint, upholstery material and trim material for automobiles are mounted to each of the sample sheets, as shown in FIG. 2, with each of the turntable assemblies including different types of swatches. For example, the first turntable assembly 58 typically would include samples of exterior paint color for automobiles, the second turntable assembly 59 generally would include swatches of materials such as leather, fabric, etc., in varying colors indicative of the types of upholstery available for an automobile, while the third turntable assembly 60 generally would include samples of materials and colors for the trim of an automobile. Further, while the present invention has been illustrated as having three turntable assemblies it should be understood that the kiosk assembly also can be constructed with a greater or lesser number of turntable assemblies for apprising customers of additional information and accessories of particular model automobiles as desired.

Paddles 71 are mounted to the turntable assemblies at spaced intervals about their circumference to enable ease of movement of the turntable assemblies by the customer. Each of the turntable assemblies is rotatable about vertical axis 61 independent of the other turntable assemblies so that the swatches 67, 68 and 69 illustrating the exterior paint, upholstery and trim colors and materials can be mixed and matched by the customer in any desired combination. Additionally, a lower alignment arrow or indicator 72 is mounted in the support channel 41 at the front of the kiosk assembly, positioned adjacent the upper platform of the base. The alignment arrow 72 enables the different swatches 67, 68 and 69 to be aligned for comparison.

A video screen support platform 75 is mounted on the internal core 55, positioned above the third turntable assembly 61 as illustrated in FIG. 3. The video screen support platform generally is a substantially cylindrically shaped plate formed from MDF or similar laminate material having an upper surface 76 and a lower surface 77. A substantially cylindrical recess 78 is formed in the lower surface, approximately in the center thereof and is of the diameter slightly greater than the diameter of the internal core 55. The upper edge of the internal core is received within the recess 78 in tight frictional engagement to mount the video screen support platform on the internal core.

As FIG. 1B illustrates, a C-shaped collar 79 is attached to the upper surface 76 of the video screen support platform 75. The collar is an arcuate strip extending substantially about the circumference of the video screen support platform. The collar is formed from MDF or similar material and is approximately 3–4 inches in width and ½–¾ inch in height and includes an open space or section 81. A video display monitor 82 (FIGS. 1B and 2) is received on the upper surface 76 of the video screen support platform 75, within the space defined by the collar 79. The video monitor generally is a touch screen interactive-type monitor that enables customers to directly input choices for color and material combinations for exterior paint, upholstery and trim of an automobile by touching choices displayed on the screen 83 of the video monitor. The video monitor communicates with the computer processing unit 34 (FIG. 1B) and the video projection means 36 via cables (not shown) extended through a cable opening or passage 84 formed through the video screen support platform 75. An upper alignment arrow 85 also is mounted in the peripheral side wall of the video screen support platform, aligned with the lower alignment arrow 72. The two alignment arrows 72 and 84 are used to align the selected swatches 67, 68 and 69 of the turntable assemblies for comparison.

A cap 90 is mounted on top of the video screen support platform, positioned above the video monitor 82 positioned thereon. The cap 90 generally is an open-top cylinder having a bottom plate 91 and an upper ring 92 of MDF material spaced from and supported above the bottom plate by a series of supports 93 and channel sections 94. The supports generally are aluminum rods or poles and the channel sections are of the same support channel material 41 for the base 11, and are aligned with the support channels 41 of the base 11 for aesthetic appearance. Cover sheets 96 of alucobond material, plastic or similar material are applied about the supports 93 and channel sections 94 of the cap to enclose the cap and provide the cap with a solid appearance. If desired, advertising messages also can be applied or printed on the cover sheets 96. Additionally, a cable opening or passage 97 is formed in the bottom plate 91 of the cap to enable passage of power cords or cables through the cap to the video display monitor 82, computer processing unit 34, and the video projection means 36 from an overhead power supply. The cap further includes a series of support legs 98 mounted to the lower surface of bottom plate 91 and extending downwardly therefrom. The support legs generally are rods or poles of a metal such as aluminum and are received within openings or bores 99 formed in the upper surface 76 of the video screen support platform 75 to mount the cap on the video screen support platform.

Additionally, as shown in FIGS. 1B and 2, a pair of screens are mounted about the support legs 98 substantially covering the sides and rear of the video monitor. The screens 101 generally are substantially rectangular shaped sections of a metal mesh or screen, approximately 18–20 inches in height and approximately 30–32 inches in length, depending upon the height of the support legs 98. The screens each have a hooked front end portion 102 that wraps about a support leg adjacent the video screen 83 of the video display monitor 82 to secure the front edge of the screen thereabout, and further include a rear edge 103 (FIG. 1B) adapted to engage and fasten to a support channel 104. The support channel 104 is formed from the same extruded material as the support channels 41 and is mounted to the bottom plate 91 of the cap, positioned approximately at the rear of the video monitor. Typically, the rear edges 103 of the screens are attached to the support channel 104 by fasteners such as bolts or pins to secure the rear edges of the screens to the support channel section. The screens cover the sides and rear of the video monitor to protect the video monitor, while enabling free passage of air about the sides and rear of the video display monitor to enable heat generated by the video display monitor to dissipate to prevent overheating of the video display monitor during continued use.

Additionally, a shelf or tray (not shown) can be mounted to the side of the interactive information kiosk assembly 10 adjacent the upper platform 23 of the base 11. The shelf generally includes a flat, horizontally oriented portion mounted on a cylindrical or tubular support. The shelf is mounted to the kiosk assembly by removing the lower alignment arrow 72 and inserting the tubular support within the passage vacated by the lower alignment arrow. The shelf further includes a passage through which a connecting cable for a computer keyboard can be fed, with the cable passing into the base and connecting to the computer processing unit. The connection of the keyboard enables the computer processing unit to be programmed with additional information or the existing programming of the computer processing unit to be modified to update the computer with changes, additions and deletions of colors, styles and materials for the exterior paint, upholstery and trim of specific model automobiles displayed by the kiosk assembly.

In operation of the interactive information kiosk assembly 10 (FIGS. 1A and 2), a customer rotates the turntable assemblies 58, 59 and 61 about the vertical axis extending through the kiosk assembly to review and the swatches 67, 68 and 69 of colors, styles and materials for the exterior paint, upholstery and trim for a particular model automobile. The customer aligns a selected swatch of exterior paint 67 with an upholstery material swatch 68 and a swatch of trim material 69, with the selected swatches arranged between the indicator arrows 72 and 85. The customer thus is able to compare quickly and directly a selected trim and/or upholstery material and color with a selected trim material and color and/or with a particular exterior paint color.

Once a customer has selected a particular color and material combination, the customer can enter his or her choices for exterior paint color, trim and upholstery materials and colors into the computer processing unit by touching the choices displayed on the screen 83 of the video display monitor 82. In response, the computer processing unit advises the customer as to the availability of the selected combination of colors, styles and materials for a particular model automobile. If the selected combination is available, the computer processing unit engages the video projection unit to create a three-dimensional video image of an automobile having the selected exterior paint color, and the selected color, style and material upholstery and trim, and displays this image on the screen of the video display monitor.

The video image displayed is a three dimensional image, which the customer is able to manipulate to view the car from various viewpoints. The customer further is able to look at the layout of the interior and trim in relation to the exterior paint color of the automobile for a particular model automobile. Thus, the customer is able to visualize quickly and accurately how his or her choices for exterior paint, upholstery and trim colors and materials would appear on a certain model automobile without having to view a particular automobile having his or her desired color and materials combinations. A printer can be connected to the kiosk assembly to enable the customer to obtain a print copy of the displayed image. Additionally, the present invention thus is simple and easy to use so that a customer can generate a desired video image without requiring sales assistance.

It will be understood that the foregoing relates only to a preferred embodiment of the present invention, and that numerous changes and modifications may be made therein without departing from the spirit and scope of the invention.

We claim:

1. An information kiosk for enabling selection and matching of colors and materials for the exterior paints, upholstery and trim of automobiles, comprising:

a base;

a series of turntable assemblies mounted in stacked series on and supported by said base and rotatable about a vertical axis extending through said base, including a first turntable assembly having a series of swatches of colors indicative of colors for the exterior paint of an automobile, a second turntable assembly mounted adjacent said first turntable assembly and having a series of swatches indicative of the colors and materials available for the upholstery of an automobile, and a third turntable assembly mounted adjacent said first and said second turntable assemblies and having a series of swatches indicative of colors and materials available for the trim of an automobile;

a video display monitor mounted above said turntable assemblies and connected to a processing unit for generating a video image of an automobile having a desired exterior paint color and a desired color and material style upholstery and trim; and a video screen support platform removably mountable to said base, said support platform being positioned above said turntable assemblies for supporting said video display monitor thereon;

whereby said turntable assemblies can be rotated with respect to one another about said base to align swatches of exterior paint, upholstery, and trim for an automobile in desired combinations to provide a quick visual indication of the appearance and matching of differing exterior paint colors with various materials and colors for upholstery and trim of an automobile.

2. The information kiosk of claim 1 and wherein said video display monitor comprises an interactive touch-screen display.

3. The information kiosk of claim 2 and wherein said processing unit is programmed with the availability of all combinations of exterior paint colors and trim and upholstery colors and materials shown on said turntable assemblies for particular model automobiles and for generating a video image of an automobile having a particular selected color and material combination and for indicating the non-availability of selected combinations.

4. The information kiosk of claim 1 and wherein said base includes a series of spaced supports, and a plurality of shelves adjustably mountable along the length of said supports.

5. The information kiosk of claim 1 and further including an internal cylindrical core mounted to said base at an upper end thereof and about which said turntable assemblies are received, and sets of rollers mounted in series about the circumference of said core spaced vertically from one another and in engagement with said turntable assemblies to support said turntable assemblies in a vertically stacked alignment while enabling said turntable assemblies to rotate freely about said core to align said swatches of said turntable assemblies in desired combinations.

6. The information kiosk of claim 1 and wherein the kiosk is substantially cylindrically shaped.

7. The information kiosk of claim 1 and further including roller means mounted to said base to enable the kiosk to be moved easily to a desired location.

* * * * *